US005805015A

United States Patent [19]

Bruccoleri et al.

[11] Patent Number: 5,805,015

[45] Date of Patent: Sep. 8, 1998

[54] CURRENT GENERATOR STAGE USED WITH INTEGRATED ANALOG CIRCUITS

[75] Inventors: Melchiorre Bruccoleri, Genoa; Gaetano Cosentino, Catania; Marco Demicheli, Binago; Giuseppe Patti, Favara, all of Italy

[73] Assignees: SGS-Thomson Microelectronics S.r.l., Agrate Brianza; Consorzio per la Ricerca Sulla Microelettronica Nel Mezzorgiorno, Catania, both of Italy

[21] Appl. No.: 629,320

[22] Filed: Apr. 8, 1996

[30] Foreign Application Priority Data

May 31, 1995 [EP] European Pat. Off. ..... 95830226

[51] Int. Cl.[6] ..... G05F 3/16

[52] U.S. Cl. ..... 327/538; 327/541; 327/543

[58] Field of Search ..... 327/101–103, 327/337, 376, 377, 538, 540, 541, 543; 323/315, 317; 330/288

[56] References Cited

U.S. PATENT DOCUMENTS

| | | | |
|---|---|---|---|
| 4,525,682 | 6/1985 | Lai et al. | 330/288 |
| 5,134,320 | 7/1992 | Perusse | 327/382 |
| 5,227,714 | 7/1993 | Lou | 323/315 |
| 5,408,174 | 4/1995 | Leonowich | 323/315 |
| 5,548,240 | 8/1996 | Bayer | 327/377 |
| 5,557,194 | 9/1996 | Kato | 323/315 |

FOREIGN PATENT DOCUMENTS 60-167013 8/1985 Japan .

OTHER PUBLICATIONS

Miyamoto, Hirosh, et al., "Substrate–Voltage Control Circuits for DRAMs at Power–On Timing," *Electronics and Communications in Japan, Part II*: vol. 75, No. 8, Aug. 1992, pp. 54–62.

*Primary Examiner*—Timothy P. Callahan
*Assistant Examiner*—T. T. Lam
*Attorney, Agent, or Firm*—Seed and Berry LLP; David V. Carlson; Paul F. Rusyn

[57] ABSTRACT

A current generator stage for integrated analog circuits includes a current source connected between a supply voltage and a ground terminal. A current mirror is operationally connected to the current source to generate an output current. A bias circuit is operationally connected to the current source to perform switching of the current source from a first operating mode to a second operating mode. The bias circuit includes an energy storage circuit which, in a first circuit configuration, supplies to the current source a first predetermined voltage when the current source is in the first operating mode. The energy storage circuit in a second circuit configuration is a combination of first and second reactances to supply to the current source a second predetermined voltage when the current source is in the second operating mode.

16 Claims, 6 Drawing Sheets

CURRENT GENERATOR STAGE USED WITH INTEGRATED ANALOG CIRCUITS

BACKGROUND OF THE INVENTION

1. Field of the Invention

The present invention relates to current generator stages used in integrated analog circuits either as biasing elements or as load devices in amplifier stages.

2. Description of the Related Art

Generally, current generator stages used in integrated electronic circuits are implemented with circuit structures of which an example is shown in FIG. 1.

The current generator stage shown in FIG. 1 and designated with the number 1 includes a current source 2 connected between a supply voltage Vdd and a ground terminal GND. The current source 2 has an input node A for receiving a fixed reference current Ir and an output node B to generate an output current.

The current generator stage 1 also includes a current mirror 5 having an input terminal connected to the output node B. The current mirror 5 includes a plurality of output branches (6,7,8, . . . ) each capable of generating a driving current (I1out,I2out,I3out, . . . ) to drive circuit structures not shown in FIG. 1 and incorporated in a user stage 9.

The current generator stage 1 also includes a bias circuit 10 connected between the input node A and the ground terminal GND to perform switching of the current source from a power down condition to a power up condition. More specifically, the bias circuit 10 includes a capacitor Ccomp connected in parallel with a switch T1 which is driven by a control logic circuitry not shown in FIG. 1.

As concerns operation of the current generator stage 1 the power down phase is relatively fast because it is performed by the discharge of the capacitor Ccomp to the ground terminal GND through the switch T1. Contrariwise the power up phase is rather slow because the capacitor Ccomp has to be charged by the current Ir. The charge time τon of the capacitor Ccomp is approximatively:

$$\tau on \sim Va*Ccomp/Ir$$

where Va is the voltage on the input node A. For some applications at high frequency this value of τon is not tolerable.

Usually, to decrease this charge time a second circuit structure of the current generator stage 1 is used. In this second circuit structure, of which an example is shown in FIG. 2, the bias circuit 10 includes only the capacitor Ccomp while the first output branch 6 and the second output branch 7 of the current mirror 5 are separated by first T1 and second T2 switches. The second switch T2 being connected in parallel with the output branch 7.

As concerns operation of the second circuit structure the power down phase it is performed by opening the switch T1 and closing the switch T2. Contrariwise the power up phase it is performed by closing the switch T1 and opening the switch T2. With this second circuit structure there is reduction both of power down time and power up time of the current generator stage. However, the presence of a voltage ΔV on the switch T1, due to the intrinsic resistance Ron of this switch, causes an error on the output currents (I1out, I2out,I3out, . . . ). Consequently this second circuit structure is ineffective in all those applications which require high accuracy.

SUMMARY OF THE INVENTION

It is an object of the present invention to provide a current generator stage for integrated analog circuits having reduced power down and power up times.

The preferred embodiment of the invention is implemented in a current generator stage used with integrated analog circuits and operationally connected to a user stage, wherein the current generator stage provides a driving current to the user stage. The current generator stage includes a current source connected between a supply voltage and a ground terminal. The current source has an input node for receiving a fixed reference current and an output node to generate an output current. The current generator stage also includes a current mirror operationally connected to the current source to generate the driving current. The current generator stage also includes a bias circuit operationally connected to the current source to perform switching of the current source from a first operating condition to a second operating condition. The bias circuit includes first and second switched reactances to supply to the input node of the current source first and second predeterminated voltages, wherein the current source is in the first operating condition in response to the first predeterminated voltage and in the second operating condition in response to the second operating voltage. The bias circuit also includes means for rapidly switching it from the first operating condition to the second operating condition. These means use charge stored in the bias circuit to reduce the time for charging the input node of the current source to the second predeterminated voltage.

The features and advantages of the current generator stage according to the present invention will become apparent from the following description of an embodiment thereof, given by way of example and not limitation, with reference to the accompanying drawings.

DETAILED DESCRIPTION OF THE PREFERED EMBODIMENT

The figure of the accompanying drawings generally and schematically illustrate a current generator stage used with integrated analog circuits in accordance with the invention.

Figure 3:
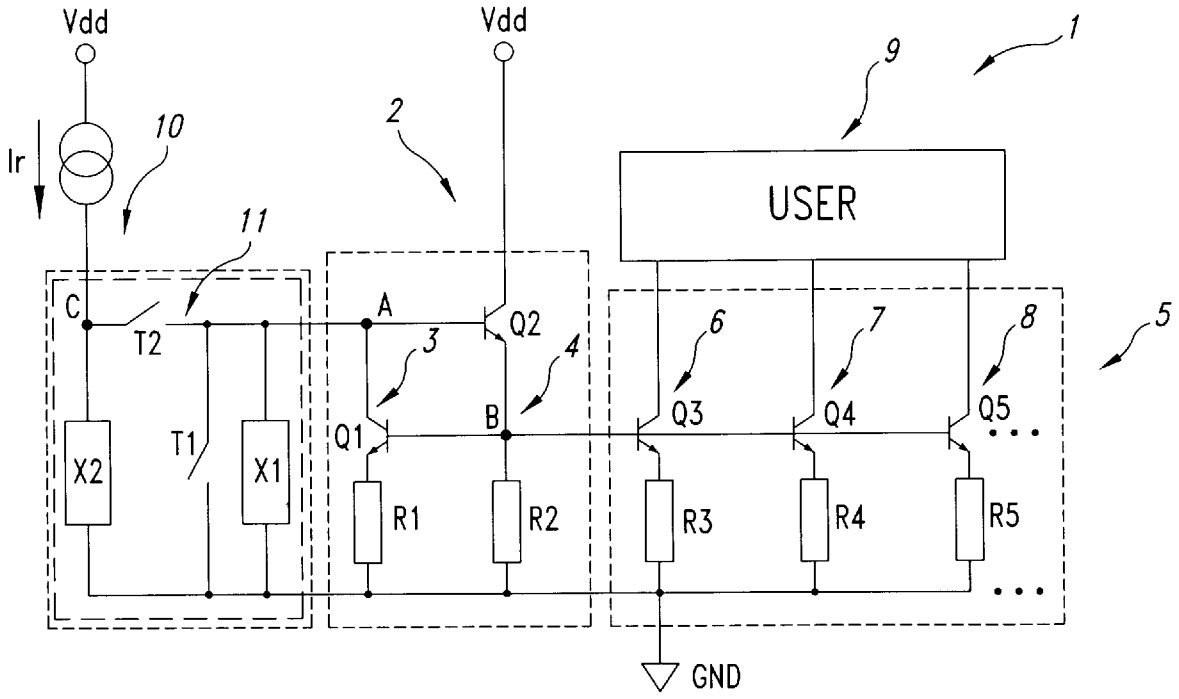
FIG. 3 is a circuit diagram of a current generator stage constructed according to the invention.

With particular reference to FIG. 3 a preferred embodiment of the inventive current generator stage is designated by reference number 1. The current generator stage 1 includes a current source 2 connected between a supply voltage Vdd and a ground terminal GND, the current source 2 having an input node designated with A. The input node A is coupled to a node C which receives a fixed reference current Ir generated by a fixed current generator connected to the supply voltage Vdd. The current source 2 also includes an output node designated with B to generate an output current.

The current generator stage 1 also includes a current mirror 5 having an input terminal connected to the output node B. The current mirror 5 includes a plurality of output branches (6,7,8, . . . ) each capable of generating a driving current (I1out,I2out,I3out, . . . ) to drive circuit structures not shown in FIG. 3 and included in a user stage 9.

Figure 5:
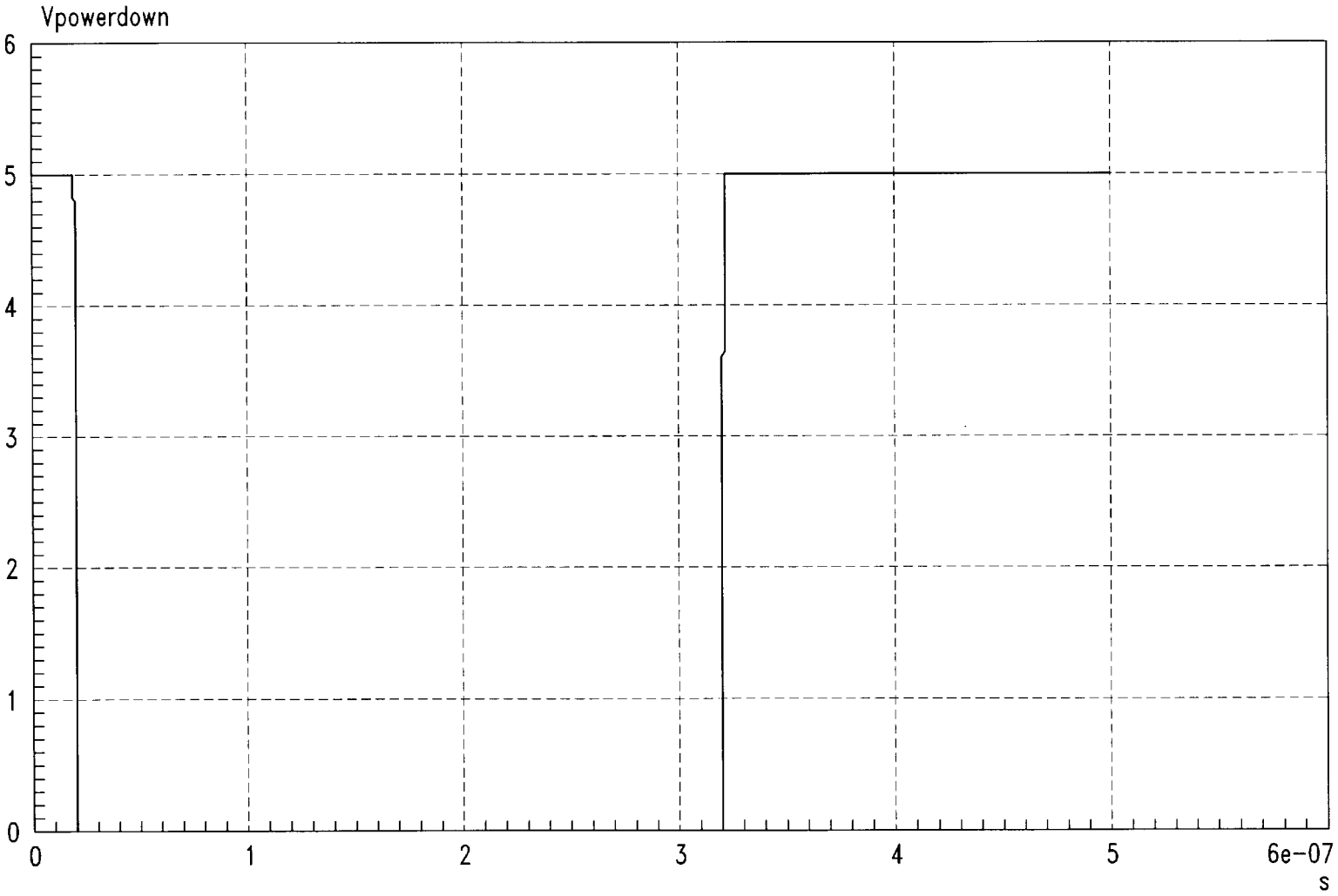
FIGS. 5 and 6 are graphs, with the same time base, of electrical signals present in the current generator stage of FIG. 3.

The current generator stage 1 also includes a bias circuit 10 connected between the input node A and the ground terminal GND to perform switching of the current source from a power down condition to a power up condition. The bias circuit 10 includes first X1 and second X2 switched reactances to supply to the input node A first and second predeterminated voltages. The current source 2 is in the power down condition in response to the first predeterminated voltage and in the power up condition in response to the second prederminated voltage. The bias circuit 10 also includes means for rapidly switching it from the power down condition to the power up condition. These means include first T1 and second T2 switches which use charge stored in the bias circuit 10 to reduce the time for charging the input node A to the second prederminated voltage. More specifically the first switch T1 is connected in parallel with the first reactance X1 while the second switch T2 is connected between the first switch T1 and the node C. The first reactance X1 is connected between the input node A and the ground terminal GND while the second reactance X2 is connected between the node C and the ground terminal GND. The two switches T1 and T2 are driven by a control logic circuitry not shown in FIG. 3. The circuitry is capable of generating a digital signal S1 of the type shown in FIG. 5.

Figure 4:
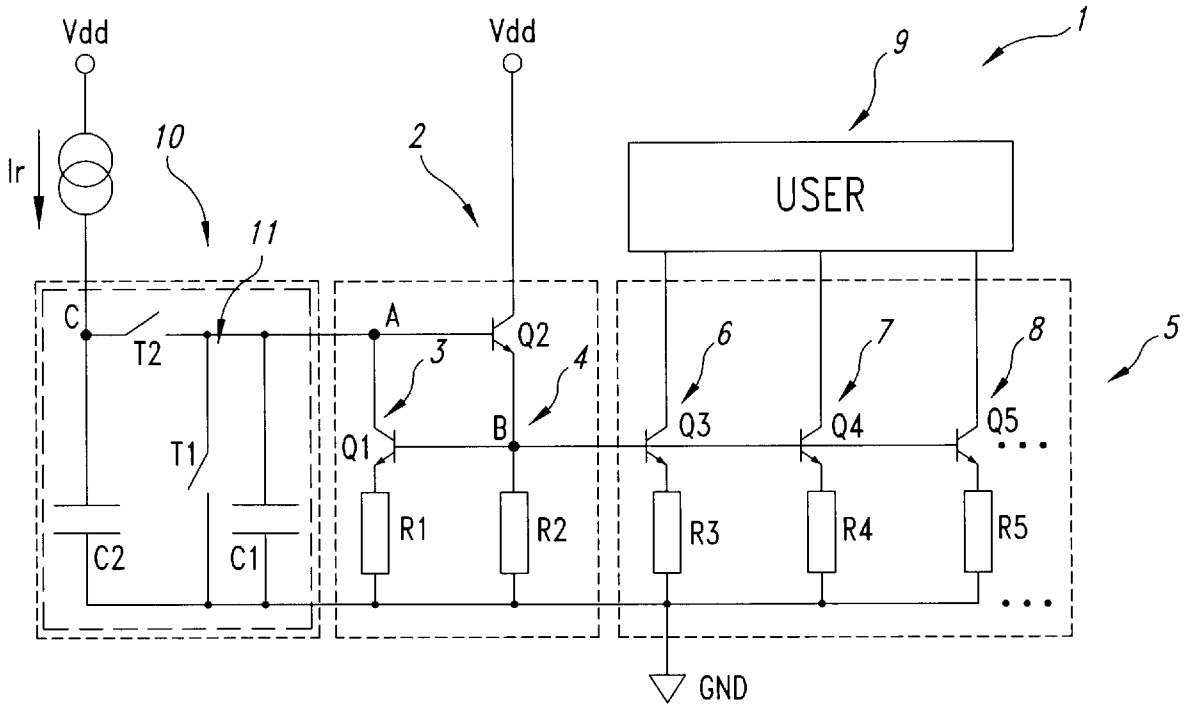
FIG. 4 is an embodiment of the circuit diagram illustrated in FIG. 3.

FIG. 4 shows a circuit embodiment of stage 1 in which the first reactance X1 and the second reactance X2 include a first capacitor C1 and a second capacitor C2, respectively.

There is now described operation of the current generator stage 1 in accordance with the present invention with particular reference to an initial state in which the stage is in operating condition.

Figure 1:
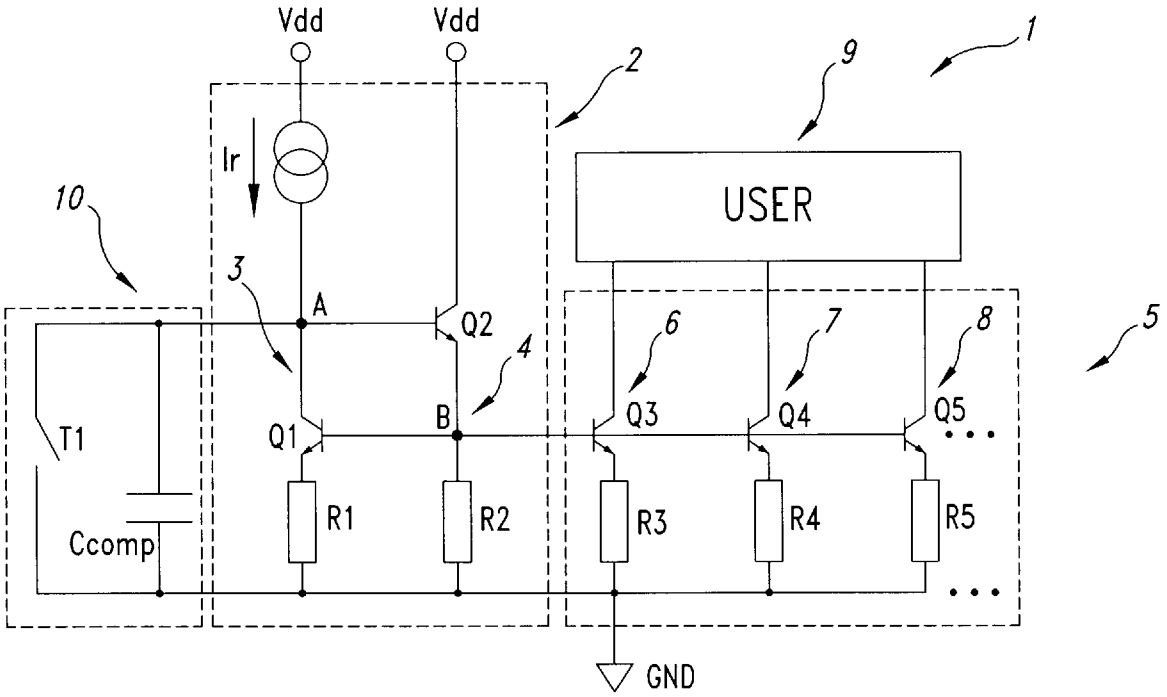
Fig. 1 (PRIOR ART)
FIG. 1 is a circuit diagram of a current generator stage in accordance with the prior art.
Figure 2:
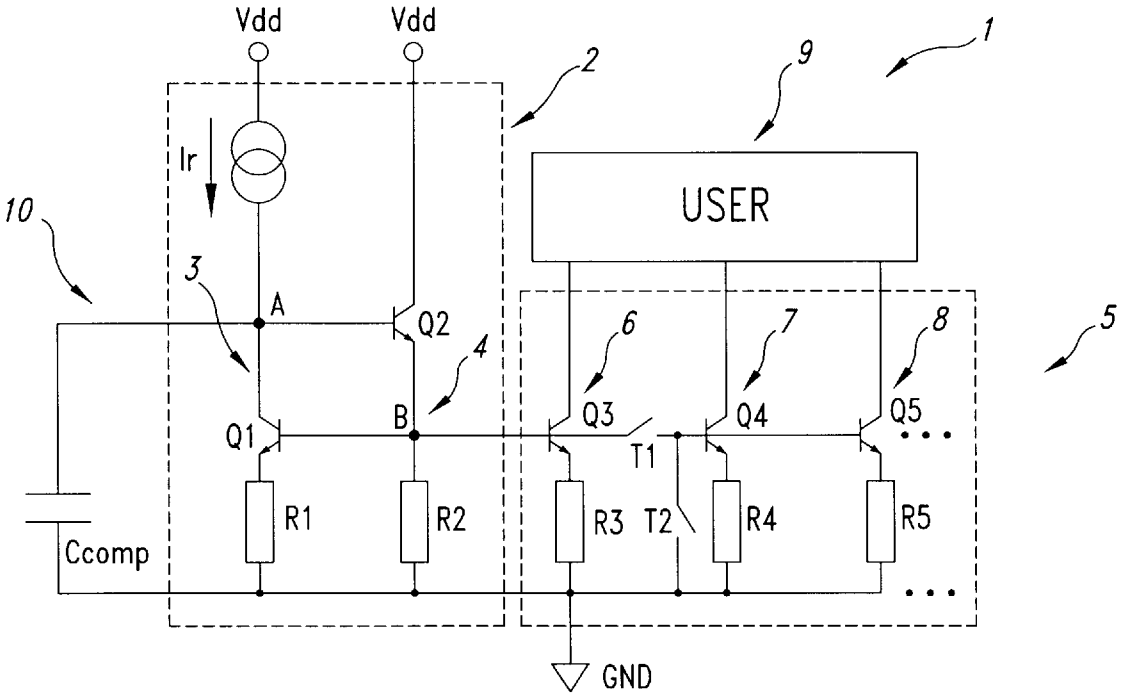
Fig. 2 (PRIOR ART)
FIG. 2 is a further embodiment of the circuit diagram illustrated in FIG. 1.

With the reference to the FIG. 4 in operating condition the first switch T1 is open while the second switch T2 is closed. In this condition the nodes A and C are at the same voltage Vf while the drop in potential of the switch T2 is disregarded. The power down phase of stage 1 is performed by closing the switch T1 and opening the switch T2. In this phase the node C is to the supply voltage Vdd while the input node A is connected to the ground terminal GND, so that the first prederminated voltage corresponding to ground. The power down of the stage 1 is relatively fast because it depends only on the discharge to the ground terminal GND of the first capacitor C1 through the switch T1. The power down phase of the stage 1 is faster than that of the stage shown in FIG. 1 because the capacitor C1 is smaller than the capacitor Ccomp.

The power up phase of the stage 1 is performed by opening the switch T1 and closing the switch T2. In this phase the charge accumulated on the second capacitor C2 during the power down phase is distributed between the first capacitor C1 and the second capacitor C2. At the beginning of the power up phase on the second capacitor C2 there is an accumulated charge equal to:

$$Q=C2*Vdd.$$

When the charge is distributed between the two capacitors C1 and C2 there is:

$$Q=(C1+C2)*V'$$

where V' is the voltage present on the first capacitor C1 at the end of the charge transitory. The voltage V' correspond to the second predeterminated voltage and it is equal to:

$$V'=Vdd\ (C2/C1+C2).$$

If V' is made equal to Vf the power up phase of stage 1 is very fast because the first capacitor C1 is charged by the second capacitor C2 through the second switch T2 which has a very low intrinsic resistance Ron.

In conclusion, this charge distribution mechanism allows obtaining a considerably reduced power up time in comparison with the prior art while keeping circuit complexity low. In addition, the current generator stage in accordance with the present invention exhibits a significant reduction of dissipated power during the power down phase. Indeed, during this phase the current Ir is accumulated on the second capacitor C2 and not eliminated through the ground terminal GND as takes place in the prior art.

Figure 6:
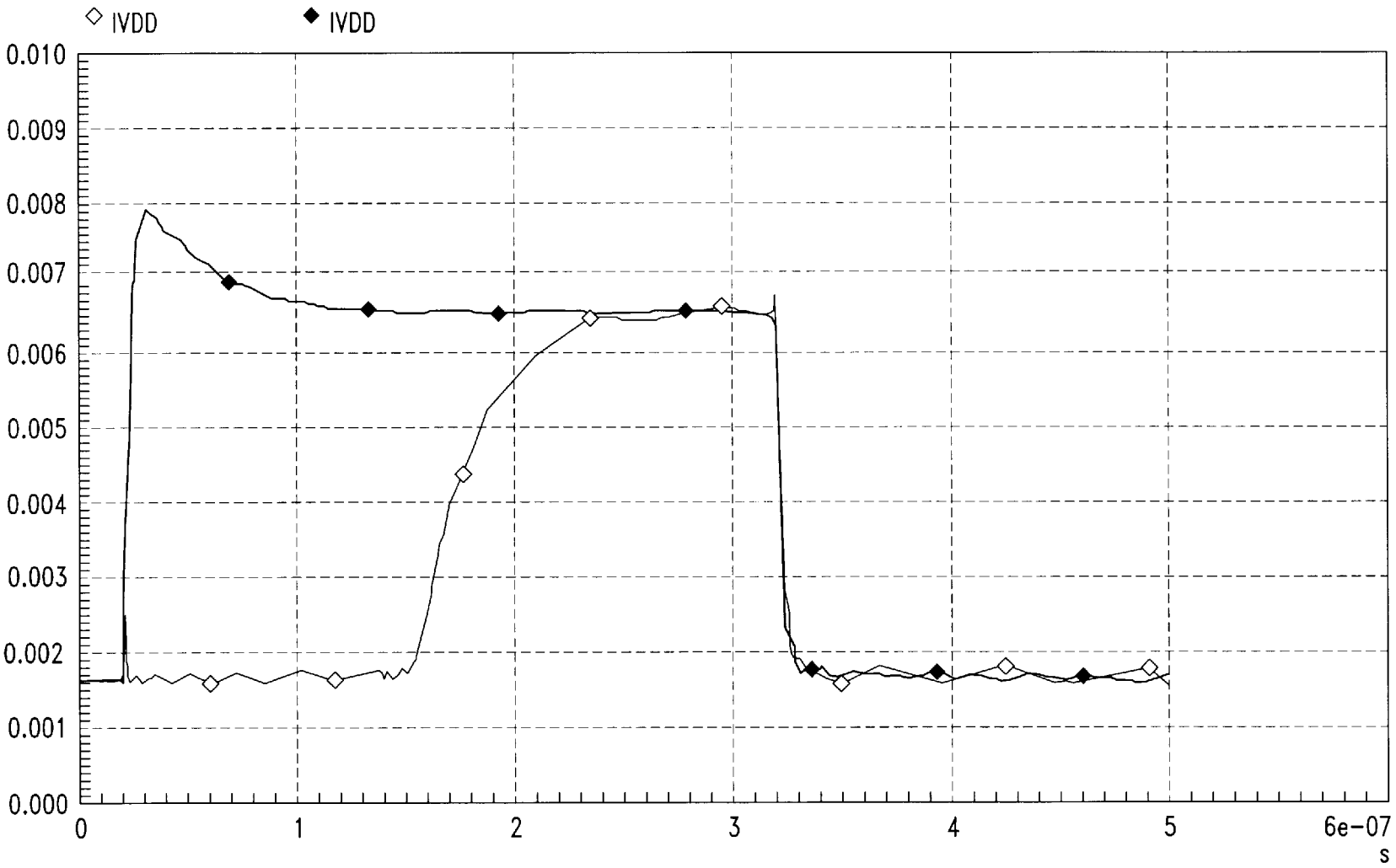

In addition, with reference to FIG. 6 showing the behavior in time of the current I(Vdd) absorbed by the supply during the power up phase, it is noted that for the proposed solution there is considerable improvement in power up time.

Finally, those skilled in the art will appreciate that the speed with which the power up phase can be accomplishied can be adjusted by adjusting the relative values of C1 and C2. Increasing C2 relative to C1 will increase the speed of the power up phase. An optimally rapid speed will be achieved at some relative capacitance values such that C2 is much greater than C1.

What is claimed is:

1. A current generator stage for integrated analog circuits, comprising:

a current source connected between a supply voltage and a ground terminal, the current source having an input terminal and an output terminal, and operable in a first mode to develop a first output current on the output terminal in response to a first predetermined voltage on the input terminal, and operable in a second mode to develop a second output current on the output terminal in response to a second predetermined voltage on the input terminal;

a current mirror connected to the output terminal of the current source, operable to generate a first driving current having a first predetermined value in response to the first output current, and operable to generate a second driving current in response to the second output current; and a bias circuit having an output terminal connected to the input terminal of the current source, the bias circuit operable to perform switching of the current source from the first mode to the second mode, wherein the bias circuit includes an energy storage circuit operable, in a first circuit configuration, to supply on the input terminal of the current source the first predeterminated voltage when the current source is in the first mode, and wherein the energy storage circuit is operable in a second circuit configuration is a combination of a first and second reactance to supply to the current source the second predetermined voltage when the current source is in the second mode.

2. The current generator stage of claim 1, wherein the first and the second reactances include respectively a first capacitor and a second capacitor separated by a first switch and a second switch.

3. The current generator stage of claim 2, wherein the first switch is connected in parallel with the first capacitor.

4. The current generator of claim 1 wherein the first driving current generated by the current mirror is approximately zero to thereby turn off the current generator stage.

5. An integrated analog circuit including a user stage operationally connected to a current generator stage, wherein the current generator stage provides a driving current to the user stage and includes:

a current source connected between a supply voltage and a ground terminal, the current source having an input node coupled to a fixed current generator and an output node to generate an output current;

a current mirror having an input terminal connected to the output node and at least one output terminal to generate the driving current; and a bias circuit connected between the input node of the current source and the ground terminal to perform switching of the current source from a first operating condition in which the driving current has a first predetermined value, to a second operating condition in which the driving current has a second predetermined value, wherein the bias circuit includes first and second switched reactances to supply to the input node of the current source first and second predeterminated voltages, wherein the current source is in the first operating condition in response to the first predeterminated voltage and in the second operating condition in response to the second predeterminated voltage, and including means for rapidly switching the bias circuit from the first operating condition to the second operating condition using charge stored in the bias circuit to reduce the time for charging the input node of the current source to the second predeterminated voltage.

6. The integrated circuit of claim 5 wherein the means for rapidly switching the bias circuit include first and second switches, the first switch being connected in parallel with the first reactance and the second switch being connected between the first switch and the fixed current generator.

7. The integrated circuit of claim 6 wherein the first reactance is connected between the input node of the current source and the ground terminal.

8. The integrated analog circuit of claim 5 wherein the first predetermined value of the driving current is approximately equal to zero.

9. A current generator stage for integrated analog circuits including:

a current source connected between a supply voltage and a ground terminal;

a current mirror operationally connected to the current source to generate an output current; and a bias circuit operationally connected to the current source to perform switching of the current source from a first operating mode to a second operating mode, wherein the bias circuit includes an energy storage circuit which, in a first circuit configuration, supplies to the current source a first predeterminated voltage when the current source is in the first operating mode, and in a second circuit configuration is a combination of first and second reactances to supply to the current source a second predetermined voltage when the current source is in the second operating mode, the first and the second reactances including a first capacitor and a second capacitor, respectively, the energy storage circuit further including a first switch connected in parallel with a first capacitors a second capacitor connected between a fixed current generator and the ground terminal, and a second switch connected between the fixed current generator and the first capacitor.

10. An integrated analog circuit including a user stage operationally connected to a current generator stage, wherein the current generator stage provides a driving current to the user stage and includes:

a current source connected between a supply voltage and a ground terminal, the current source having an input node coupled to a fixed current generator and an output node to generate an output current;

a current mirror having an input terminal connected to the output node and at least one output terminal to generate the driving current; and a bias circuit connected between the input node of the current source and the ground terminal to perform switching of the current source from a first operating condition to a second operating condition, wherein the bias circuit includes first and second switched reactances to supply to the input node of the current source first and second predeterminated voltages, wherein the current source is in the first operating condition in response to the first predeterminated voltage and in the second operating condition in response to the second predeterminated voltage, and including means for rapidly switching the bias circuit from the first operating condition to the second operating condition using charge stored in the bias circuit to reduce the time for charging the input node of the current source to the second predeterminated voltage, the means for rapidly switching the bias circuit includes first and second switches, the first switch being connected in parallel with the first reactance and the second switch being connected between the first switch and the fixed current generator, the first reactance connected between the input node of the current source and the ground terminal and the second reactance connected between the fixed current generator and the ground terminal.

11. The integrated circuit of claim 10 wherein the first and the second reactances include first and second capacitors, respectively.

12. The integrated circuit of claim 10 wherein the second capacitor is greater than the first capacitor.

13. A current generator stage for integrated analog circuits, comprising:

a current source operable in a power down mode to generate a first output current on an output in response to a first voltage on an input, and operable in a power up mode to generate a second output current on the output in response to a second voltage on the input;

a current mirror having an input coupled to the output of the current source, the current mirror operable during the power down mode to generate a first driving current in response to the first output current, and operable during the power up mode to generate a second driving current in response to the second output current; and a bias circuit including a first node coupled to the input of the current source, a first energy storage element coupled to the first node, a second node coupled to an energy source, and a second energy storage element coupled to the second node, the bias circuit operable during the power down mode isolate the first node from the second node, supply energy from the energy source to the second energy storage element, and remove energy from the first energy storage element to drive the first node to the first voltage and rapidly switch from the power up to power down mode, and operable during the power up mode to couple the first node to the second node so that energy is supplied to the first node to drive the first node to the second voltage.

14. The current generator stage of claim 13 wherein the energy source is a constant reference current.

15. The current generator stage of claim 13 wherein the first and second energy storage elements are capacitors.

16. The current generator stage of claim 13 wherein the first driving current is approximately equal to zero amperes.

* * * * *